US008568197B2

(12) United States Patent
Voice et al.

(10) Patent No.: US 8,568,197 B2
(45) Date of Patent: Oct. 29, 2013

(54) METHOD OF FLUID JET MACHINING

(75) Inventors: Wayne E Voice, Nottingham (GB); Dragos A Axinte, Nottingham (GB); Ming Chu Kong, Liverpool (GB)

(73) Assignee: Rolls-Royce PLC, London (GB)

( * ) Notice: Subject to any disclaimer, the term of this patent is extended or adjusted under 35 U.S.C. 154(b) by 662 days.

(21) Appl. No.: 12/385,657

(22) Filed: Apr. 15, 2009

(65) Prior Publication Data

US 2009/0272245 A1 Nov. 5, 2009

(30) Foreign Application Priority Data

May 2, 2008 (GB) ..... 0807964.2

(51) Int. Cl.
*B24B 49/00* (2012.01)

(52) U.S. Cl.
USPC ..... 451/5; 451/11; 451/38

(58) Field of Classification Search
USPC ..... 451/5, 11, 36, 38
See application file for complete search history.

(56) References Cited

U.S. PATENT DOCUMENTS

| | | | | |
|---|---|---|---|---|
| 5,097,731 | A | 3/1992 | Vives et al. | |
| 5,117,366 | A * | 5/1992 | Stong | 700/160 |
| 5,361,933 | A | 11/1994 | Oster | |
| 5,388,131 | A | 2/1995 | Batistoni et al. | |
| 5,573,446 | A * | 11/1996 | Dey et al. | 451/39 |
| 5,704,824 | A | 1/1998 | Hashish et al. | |
| 5,791,968 | A * | 8/1998 | Matsumura et al. | 451/5 |
| 7,419,418 | B2 * | 9/2008 | Alberts et al. | 451/2 |
| 7,544,112 | B1 * | 6/2009 | Miller et al. | 451/2 |
| 7,585,201 | B2 * | 9/2009 | Kanai et al. | 451/2 |
| 7,896,726 | B1 * | 3/2011 | Miller et al. | 451/2 |
| 8,165,713 | B2 * | 4/2012 | Alberts et al. | 700/188 |
| 2003/0187624 | A1 * | 10/2003 | Balic | 703/1 |
| 2004/0256504 | A1 * | 12/2004 | Segrest et al. | 241/1 |
| 2005/0048873 | A1 | 3/2005 | Alberts et al. | |

FOREIGN PATENT DOCUMENTS

| | | |
|---|---|---|
| DE | 200 23 864 U1 | 1/2007 |
| EP | 0 413 630 A1 | 8/1990 |
| EP | 0 758 572 A1 | 2/1997 |
| JP | A-08-85059 | 4/1996 |

OTHER PUBLICATIONS

May 6, 2010 European Search Report in Appln. No. EP 09 25 1037.

* cited by examiner

*Primary Examiner* — Maurina Rachuba
(74) *Attorney, Agent, or Firm* — Oliff & Berridge, PLC

(57) ABSTRACT

A pocket (6) is machined into the surface of a component (9) by pressurising a fluid (1) and directing a jet (11) of the pressurized fluid (1) at the surface to be machined. Continuous relative movement is provided between the component (9) and the pressurized jet (11) of fluid (1) during machining. Material is removed from the component (9) in a series of layers, whereby the path of the fluid jet (11) in one of the layers is perpendicular to the path of the fluid jet (11) in the subsequent layer. The fluid jet (11) operates continuously until the required amount of material has been removed from the component (9).

14 Claims, 4 Drawing Sheets

Plain WaterJet Systematic Flow Chart

Enhanced Plain WaterJet Neural Network Training System

METHOD OF FLUID JET MACHINING

BACKGROUND

The present invention relates to fluid jet machining and in particular to the use of fluid jets to machine to controlled depths in hard materials.

It is known to machine objects using high velocity water jets including an abrasive. In abrasive water jet systems a finely divided abrasive material is entrained in a high pressure jet of water which is directed at a component to be machined. Abrasive water jets are increasingly used in the manufacturing industries and have been successfully employed to cut relatively soft-materials to precise shapes. Difficulties have however been encountered in using water jets as a precision tool on harder materials due to difficulties in controlling the depth of cut.

In U.S. Pat. No. 5,704,824 an abrasive water jet is used to machine a component. The jet is attached to a manipulator which allows the jet to be moved in three dimensions. The apparatus allows for continuous variation in the position and strength of the jet as well as variations in the speed of relative motion between the jet and the component. A mask, of harder material, is positioned between the jet and the component and has an opening through which the jet is directed to machine the surface of the component. The mask is provided to define the area to be worked whist covering and thus protecting adjacent areas of the component.

SUMMARY

A disadvantage of using an abrasive water jet is that the abrasive becomes embedded in the surface and can result in a reduction in the fatigue life of the machined component. Further the provision of a mask incurs extra costs in manufacturing the mask, setting up the mask and cleaning the mask both before and after the component is machined with the water jet.

The present invention seeks to provide an improved method of water jet machining which eliminates the need to use either an abrasive or a mask.

According to the present invention a method of machining at least a part of a component comprises the steps of pressurising a fluid and directing a jet of the pressurised fluid at the part of a component to be machined, providing continuous relative movement between the component and the pressurised jet of fluid during machining, removing a required amount of material from the component in a series of layers, whereby the path of the fluid jet in one of the layers is perpendicular to the path of the fluid jet in the subsequent layer and the fluid jet operates continuously until the required amount of material has been removed.

The fluid jet completes a number of passes across the component when removing material from a single layer and these passes may be parallel to one another.

In the preferred embodiment of the present invention the fluid jet zigzags across the component to remove material from each of the layers and the fluid jet completes an identical number of passes across the component in either alternate layers or in every layer.

Preferably the starting point for the path of the fluid jet in one layer is the end point of the path of the fluid jet in the preceding layer.

A pocket may be formed in the surface of a component and on completion of cutting in one layer the fluid jet traverses around the periphery of that cut layer before commencing cutting of the next layer.

The fluid jet may traverse in different directions around the periphery of each layer depending upon the layer being machined.

The fluid jet moves relative to the component at a constant speed and may include an abrasive.

The fluid jet is controlled by a CNC machine which automatically generates the path of the fluid jet. The CNC machine may be controlled via a neural network so that the system can be trained to improve the machining process.

BRIEF DESCRIPTION OF THE DRAWINGS

The present invention will now be described with reference to the figures in which.

DETAILED DESCRIPTION

Figure 1:
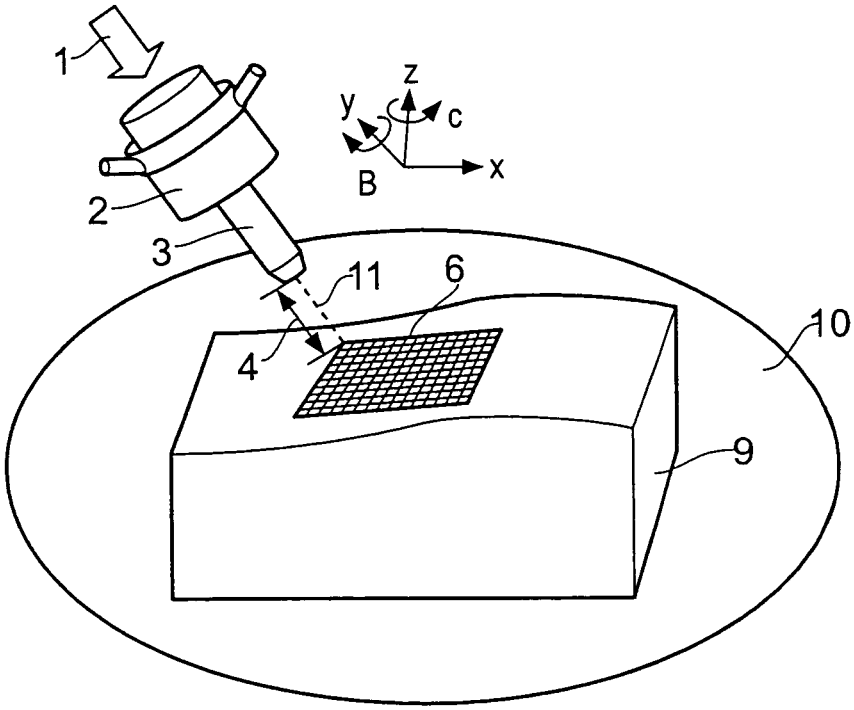
FIG. 1 is a schematic view of water jet machining a component in accordance with the present invention.

Referring to FIG. 1 a component 9 is mounted on a turntable 10, capable of rotation through 360°. A fluid 1, such as water, is pressurised in a cutting head 2 and is directed through an orifice in a nozzle 3. The pressurised water jet 11 is directed at the surface of the component 9.

A pocket 6 is machined out of the surface of the component 9 by the water jet 11. The water jet 11 is moved continuously relative to the component 9 by a 5 axis CNC machine. The five axes about which the machine can move are indicated by arrows X, Y, Z, B and C in FIG. 1.

The water jet 11 traverses in a zigzag movement across the surface of the component 9 to machine the pocket 6 to a controlled depth. By using a predetermined cutting path and specific cutting parameters a pocket 6 can be machined into the component 9 without the need for a mask.

The water jet 11 moves continuously over the surface of the component 9 following a predetermined path. FIG. 2 shows the predetermined path of a water jet 11 to cut a rectangular pocket 6 in the component 9. The path consists of a combination of movements around the profile of the pocket 6 to generate a smooth contour and zigzag movements along and across the profile but inside the contour of the pocket 6. The starting point of one of the cutting paths is at the end point of the previous cutting path so that in between the first and last cutting path the cutting is continuous. At all times the water jet 11 keeps moving forwards and does not stop. This improves the surface finish as there is no spot damage caused when a water jet becomes stationary.

The water jet 11 removes the material in layers shown in FIGS. 2*a-d*. In the first layer, FIG. 2*a*, the water jet 11 starts in one corner of the pocket 6 and traverses back and forth across the component 9 in a zigzag fashion to finish in a diagonally opposite corner of the pocket 6 marked as the end point. The water jet 11 then traverses from the end point all around the outer contour of the pocket profile in a clockwise direction back to the end point. The end point in the first layer is the starting point for the water jet in the second layer, FIG. 2*b*. The water jet 11 now zigzags back across the pocket 6 cutting along a path perpendicular to the first cutting path. Once this path is completed the water jet 1 again traverses around the contour of the pocket 6 in an anti-clockwise direction.

Figures 2A, 2B, 2C, 2D:
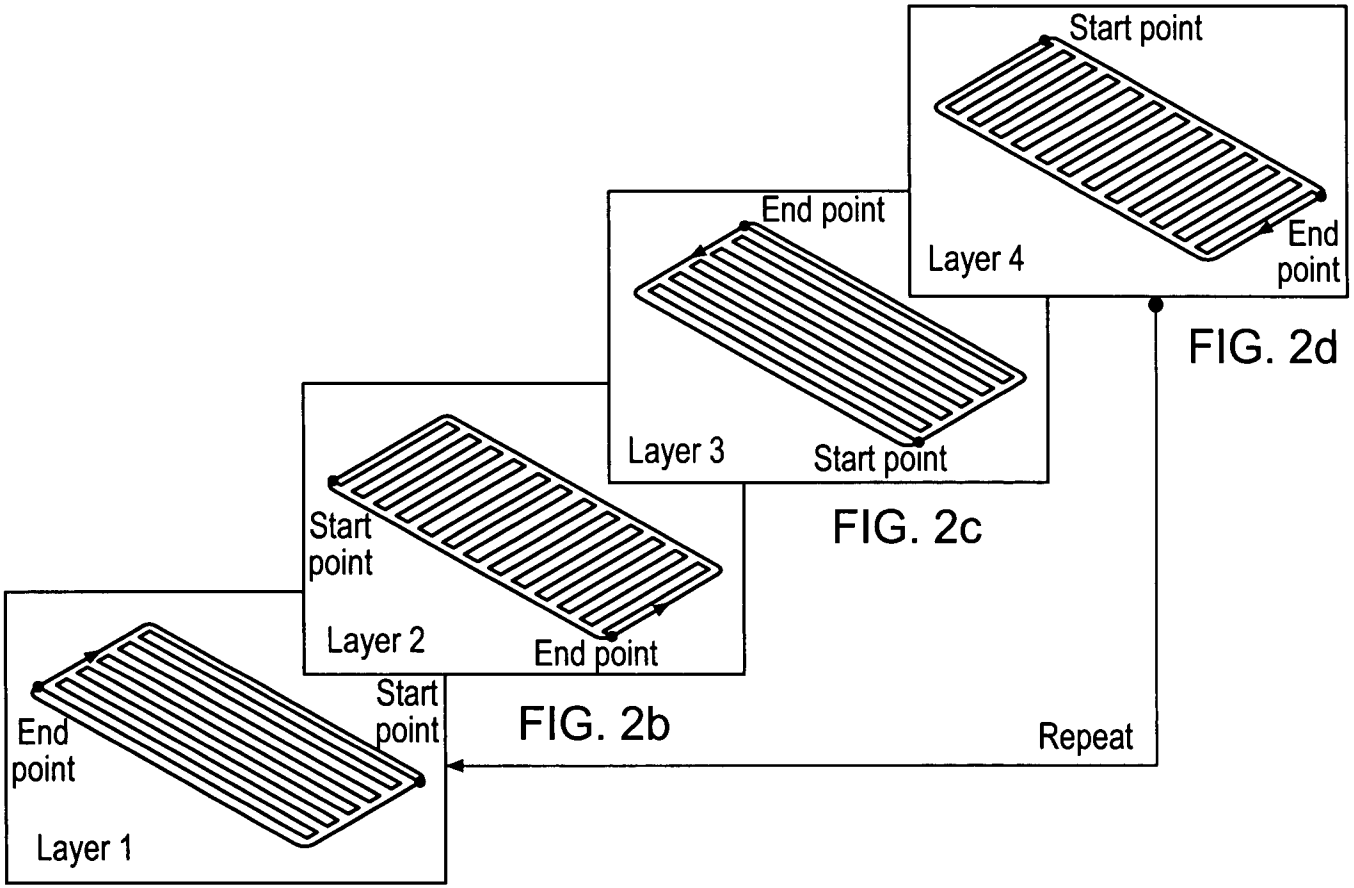
FIGS. 2*a-d* show the path a water jet follows to machine a rectangular pocket in the surface of a component.

This process is repeated in the third and fourth layers, FIGS. 2*c* and 2*d*, with the water jet 11 starting at the end point of the previous layer.

The cutting path in each layer is perpendicular to the cutting path in the previous layer and is completed by the traverse of the water jet 11 around the pocket profile. The direction of traverse of the water jet 11 around the profile of the pocket 6 may alternate between the layers. For example in the embodiment shown the water jet 11 travels in a clockwise direction around the profile of the pocket in the first and fourth layers, FIGS. 2*a* and 2*d*. However the water jet 11 traverses in an anticlockwise direction in the second and third layers, FIGS. 22*b* and 2*c*.

The first and third layers have an identical number of passes as do the second and fourth layers. This ensures that the material is removed at a uniform rate in each layer and gives improvements in the quality of the surface finish on completion of the machining process. The removal of material in layers one to four completes a single machining cycle and once completed the jet 11 will continue and repeat the four steps again until the required amount of material has been removed. The water jet 11 neither stops in between the layers nor in between the machining cycles until a pocket 6 is machined in the component 9 to the required depth.

Figure 3:
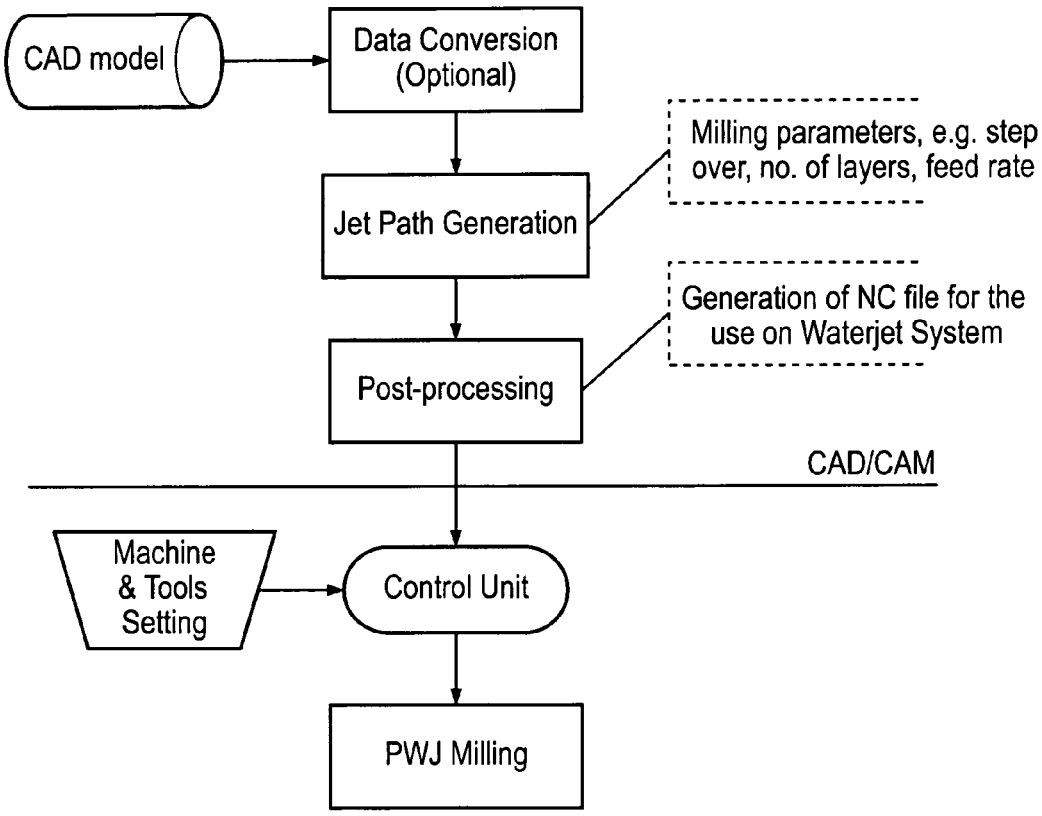
FIG. 3 is a flow chart for a water jet machining process in accordance with the present invention.

FIG. 3 is a schematic flow chart showing how the path of the water jet 11 is generated and converted to a readable CNC program used in the 5 axis CNC machine. The path is continuous and feed rate, number of layers and water jet movements are all prepared as part of the program. The only parameters that need to be set manually before cutting commences is the pump pressure and the stand off distance 7. The optimised values for these operating parameters depend on the material to be machined.

In a preferred embodiment of the present invention a water jet 11 of plain water is pressurised to 50,000 psi (~345 MPa) and is delivered to a nozzle 3 having a diameter Nd of 1 mm. By using a feed rate of 500 mm/min and a stand off distance of 3 mm a pocket was machined into the surface of a hard component made from gamma titanium aluminide. After 20 passes with a step over of Nd/2, where Nd=1 mm, the pocket was machined to a depth of 1.5 mm.

By continually moving the water jet 11 a pocket 6 is machined into the component 9 using a jet 11 of plain water without the need for a mask. This offers the advantage of saving the time and cost associated with the manufacture of a mask as well as the additional fixtures for masking. In addition, the cost associated with the abrasives can be eliminated and results in a more environmentally friendly process.

As the final cutting path in each layer is completed by traversing the water jet 11 around the pocket profile there is no need to reverse the water jet 11 and the continuous movement of the water jet 11 ensures that the speed remains constant. The resulting surface is thus more homogenous in terms of surface roughness and geometrical accuracy. Further since only a plain water jet 11 is used no grit is embedded in the surface of the component 9. This leads to further reductions in inspection times if the surface being machined is on a safety critical component.

The current system is an open loop control system and the choices of cutting parameters and jet path are dependant on expert trail and error and experience.

Figure 4:
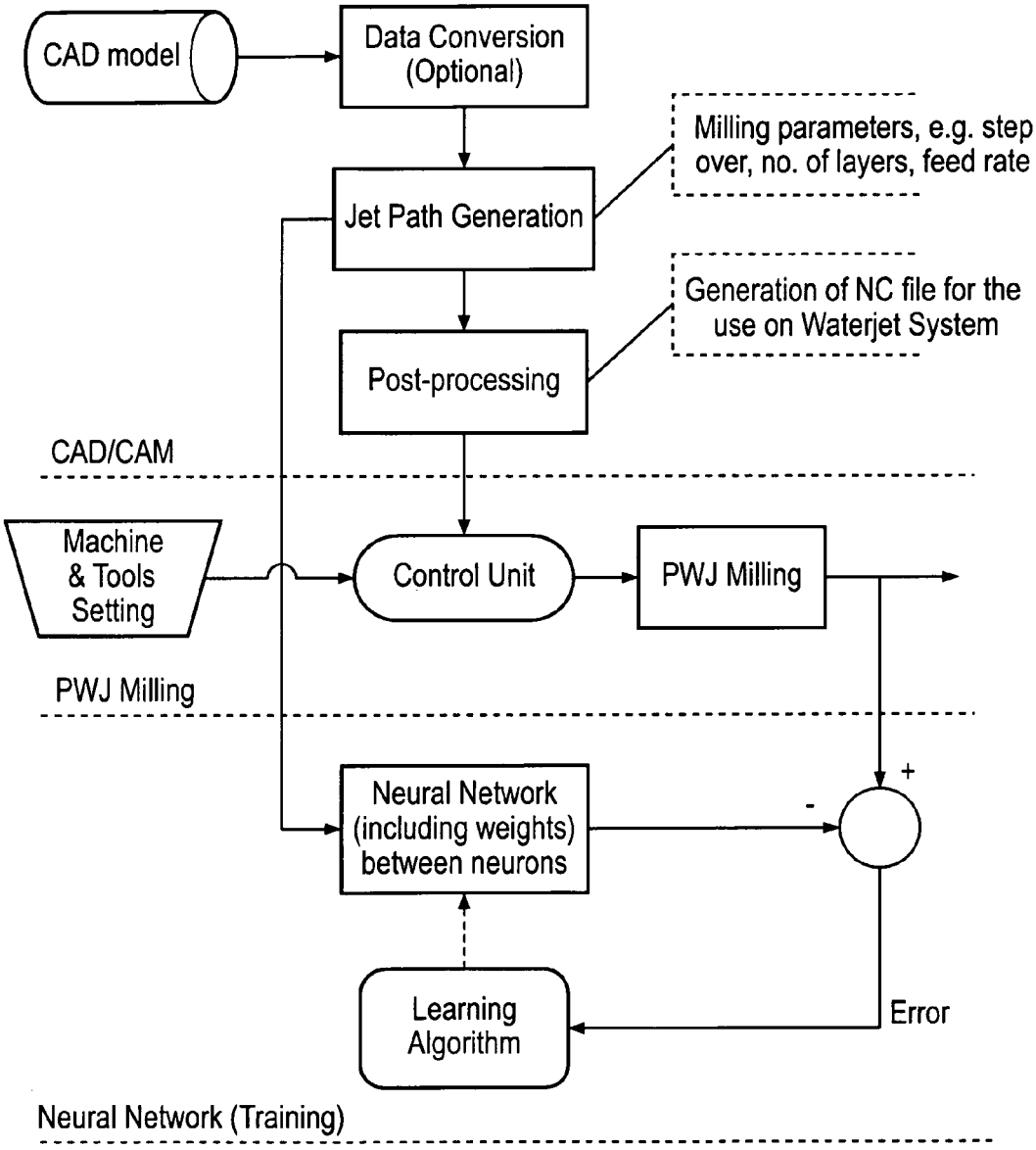
FIG. 4 is a flow chart showing an enhanced neural network training system for a water jet machining process in accordance with the present invention.

Alternatively FIG. 4 is a schematic flow chart of an advanced water jet machining process in which an artificial intelligent element such as a neural network is used. The main advantage of neural network integration is that the system can trained using data from successful cases. By comparing the predictive output with the actual machined component a learning curve can be obtained.

It will be appreciated by one skilled in the art that whilst the present invention was been described with reference to the water jet machining of pockets in the surface of a component it could be used with other fluids in other machining processes such as polishing.

The improvement in the surface finish of a component machined in accordance with the present invention is attributed to the continuous movement of a fluid jet along a predetermined path. It will therefore be realised that the present invention could be used with a fluid jet which includes an abrasive if embedded grit is acceptable in the machined component.

The invention claimed is:

1. A method of machining at least a part of a component comprising:

pressurising a fluid and directing a jet of the pressurised fluid at the part of a component to be machined;

providing continuous relative movement between the component and the pressurised jet of fluid during machining;

removing a required amount of material from the component in a series of layers; and providing continuous relative movement between the component and the pressurised jet of fluid during the removal of material from the layers and between the layers, whereby the path of the fluid jet in one of the layers is perpendicular to the path of the fluid jet in the subsequent layer and the fluid jet operates continuously until the required amount of material has been removed.

2. A method as claimed in claim 1 in which the fluid jet completes a number of passes across the component when removing material from a single layer.

3. A method as claimed in claim 1 in which the fluid jet completes a number of parallel passes across the component when removing material from a single layer.

4. A method as claimed in claim 1 in which the fluid jet zigzags across the component to remove material from each of the layers.

5. A method as claimed in claim 1 in which the fluid jet completes an identical number of passes across the component in alternate layers.

6. A method as claimed in claim 1 in which the fluid jet completes an identical number of passes across the component in every layer.

7. A method of machining at least a part of a component comprising:

pressurising a fluid and directing a jet of the pressurised fluid at the part of a component to be machined;

providing continuous relative movement between the component and the pressurised jet of fluid during machining;

removing a required amount of material from the component in a series of layers, whereby the path of the fluid jet in one of the layers is perpendicular to the path of the fluid jet in the subsequent layer and the fluid jet operates continuously until the required amount of material has been removed, and the starting point for the path of the fluid jet in one layer is the end point of the path of the fluid jet in the preceding layer.

8. A method as claimed in claim 1 in which a pocket is formed in the surface of a component.

9. A method of machining at least a part of a component, the method comprising:

pressurising a fluid and directing a jet of the pressurised fluid at the part of a component to be machined;

providing continuous relative movement between the component and the pressurised jet of fluid during machining;

removing a required amount of material from the component in a series of layers, whereby the path of the fluid jet in one of the layers is perpendicular to the path of the fluid jet in the subsequent layer and the fluid jet operates continuously until the required amount of material has been removed, and the fluid jet on completion of cutting in one layer traverses around the periphery of that cut layer before commencing cutting of the next layer.

10. A method as claimed in claim 9 in which the fluid jet traverses in different directions around the periphery of the cut layer depending upon the layer being machined.

11. A method as claimed in claim 1 in which the fluid jet moves relative to the component at a constant speed.

12. A method as claimed in claim 1 in which the fluid jet includes an abrasive.

13. A method as claimed in claim 1 in which the fluid jet is controlled by a CNC machine.

14. A method as claimed in claim 1 in which the fluid jet is controlled by a CNC machine via a neural network.

* * * * *